United States Patent [19]

Poloni et al.

[11] Patent Number: 4,922,740

[45] Date of Patent: May 8, 1990

[54] ROLLING UNIT SUPPORTED AS A CANTILEVER

[75] Inventors: Alfredo Poloni, Ronchi Dei Legionari; Nonini Geremia, Buttrio, both of Italy

[73] Assignee: Danieli & C. Officine Meccaniche SpA, Buttrio, Italy

[21] Appl. No.: 265,345

[22] Filed: Oct. 28, 1988

Related U.S. Application Data

[63] Continuation of Ser. No. 74,370, Jul. 16, 1987, abandoned.

[30] Foreign Application Priority Data

Aug. 1, 1986 [IT] Italy ..... 60440/86[U]

[51] Int. Cl.[5] ..... B21B 31/00

[52] U.S. Cl. ..... 72/237; 83/DIG. 1; 72/181; 72/235

[58] Field of Search ..... 72/238, 239, 237, 249, 72/226, 442

[56] References Cited

U.S. PATENT DOCUMENTS

| | | | |
|---|---|---|---|
| 1,044,953 | 11/1912 | Versen | 72/249 X |
| 1,192,814 | 7/1916 | Fawell | 72/229 |
| 1,833,376 | 11/1931 | Simmons | 72/226 |
| 3,555,871 | 1/1971 | Hlafcsak | 72/239 |
| 3,796,081 | 3/1974 | Boardman | 72/226 X |
| 3,805,658 | 4/1974 | Scott et al. | 83/DIG. 1 |
| 3,866,502 | 2/1975 | Brewer, Sr. | 83/DIG. 1 |
| 4,129,023 | 12/1978 | Sieurin | 72/235 |
| 4,297,931 | 11/1981 | Lessard | 83/DIG. 1 |
| 4,363,253 | 12/1982 | Cantella | 83/DIG. 1 |
| 4,557,129 | 12/1985 | Lash et al. | 72/226 X |
| 4,653,304 | 3/1987 | Feldmann et al. | 72/239 |
| 4,660,399 | 4/1987 | Suter et al. | 72/181 |

FOREIGN PATENT DOCUMENTS

| | | | |
|---|---|---|---|
| 0142879 | 5/1985 | European Pat. Off. . | |
| 338426 | 6/1921 | Fed. Rep. of Germany . | |
| 687920 | 2/1940 | Fed. Rep. of Germany . | |
| 693225 | 7/1940 | Fed. Rep. of Germany . | |
| 875035 | 4/1953 | Fed. Rep. of Germany . | |
| 1054409 | 4/1959 | Fed. Rep. of Germany . | |
| 3226694 | 1/1984 | Fed. Rep. of Germany | 72/239 |
| 1549753 | 11/1968 | France . | |
| 0044118 | 3/1985 | Japan | 72/239 |
| 0185544 | 9/1922 | United Kingdom | 72/442 |

*Primary Examiner*—W. Donald Bray

*Attorney, Agent, or Firm*—Wegner & Bretschneider

[57] ABSTRACT

Rolling unit supported as a cantilever and comprising pairs of rolls (12) which are supported as cantilevers and have their axis horizontal and/or vertical, such unit (10) including a working area (13) and at the same time an area (14) for replacement and maintenance, such two areas being different and located diametrically opposite to each other at the two sides of an axis of rotation (26), the rolling unit (10) being placed between the two areas (13–14), the axis of rotation (26) being vertical or tilted.

12 Claims, 3 Drawing Sheets

ROLLING UNIT SUPPORTED AS A CANTILEVER

This application is a continuation of U.S. application Ser. No. 074,370, filed July 16, 1987 abandoned.

BACKGROUND OF THE INVENTION

This invention concerns a rolling unit having its rolls supported as cantilevers. To be more exact, the invention concerns a rolling unit which has its rolls supported as cantilevers and is suitable to enable maintenance or replacement of the rolls and/or equipment to be carried out in very short times during rolling operations.

Rolling units supported as cantilevers are known, as also are devices to replace the rolls and/or equipment on rolling stands having their rolls supported as cantilevers, such devices comprising:

a frame with connection means, jaws with engagement means, and actuation means, the reciprocal positioning of the parts when engaged by such devices being substantially the same as the reciprocal positioning of such parts when fitted to a rolling unit.

EP-A-0142879 in the name of the present applicant should be consulted in this connection.

Such devices to replace the rolls and/or equipment enable action to be taken to reset the machine in very short times of the order of seven to ten minutes. This means that, if the personnel employed for the purpose are ready, some seven to ten minutes will go by between the time when the machine stops processing one section and the time when the machine is ready again to process the section programmed thereafter.

Such time of engagement of the rolls seems in itself to be unimportant but in fact may be very irksome.

Indeed, when small lots are being rolled, it is essential for economical running that the times for changing the section should be reduced, and such reduction can be obtained substantially by pre-arranging the rolling stand while the preceding section is still being processed.

DE TS 338.426 and FR 1.549.753 disclose two rolling stands positioned at 90° to each other and having their axis of rotation at the point of union of the axes on which they are positioned.

To replace one or the other stand by a 90° rotation, it is necessary to withdraw the adapters and reposition them.

Moreover, the rolled stock passes in the neighbourhood of the stand during maintenance and re-equipment, with serious danger for the machine operators. These embodiments therefore entail long re-equipment times and danger for the machine operators.

DE PS 687.920 discloses an auxiliary unit located momentarily in front of a rolling stand, this auxiliary unit serving to facilitate the withdrawal of two working rolls and their replacement with a fresh pair of rolls taken from a store. This device speeds up the replacement of the pair of rolls but leaves the position of the stand unchanged and does not permit work to be carried out on the roll housings unless the stand is halted.

DE 693.225 discloses two pairs of rolls which are mutually replaceable either by being slid into position or by being rotated. The proposed embodiments always provide for the previous removal and subsequent reattachment of the adapters. Moreover, the maintenance or replacement work is performed in an area which involves danger for the machine operator.

DE 875.035 discloses rapid means to adjust the rolling pressure on rolling stands.

DE 1.054.409 discloses two sets of stands which are made to rotate so as to take up alternately a reciprocal working position and a maintenance and re-equipment position.

SUMMARY OF THE INVENTION

The present applicant has studied and embodied this invention so as to reduce the maintenance and re-equipment times still further and, at the same time, to enable small maintenance jobs and the resetting of the machine to be carried out without halting the machine and without the machine operator being endangered and also to speed up the change of the working front.

According to the invention the rolling unit supported as a cantilever is divided into two portions so as to create twin units.

A rotary support which upholds such rolling unit is positioned in cooperation with the median axis of the twin units, its axis of rotation coinciding with that median axis.

The median axis is arranged to be vertical or tilted and the twin units are located as counterparts of each other in relation to the axis of rotation of the rotary support, which becomes positioned between the twin units.

The twin units are driven by one single motor with one single motion intake within the rotary support, and means to actuate one or the other of the twin units are provided. The motion intake lies on the median axis or axis of rotation.

The invention is therefore embodied with a rolling unit supported as a cantilever and comprising pairs of rolls which are supported as cantilevers and have their axis horizontal and/or vertical, such unit being characterized in that it includes a working area and at the same time an area for replacement and maintenance, such two areas being different from each other and located diametrically opposite to each other at the two sides of an axis of rotation, the rolling unit being placed between the two areas, the axis of rotation being vertical or tilted.

BRIEF DESCRIPTION OF THE DRAWINGS

The attached figures are given as a non-restrictive example and show the following.

DETAILED DESCRIPTION OF THE INVENTION

Figure 1:
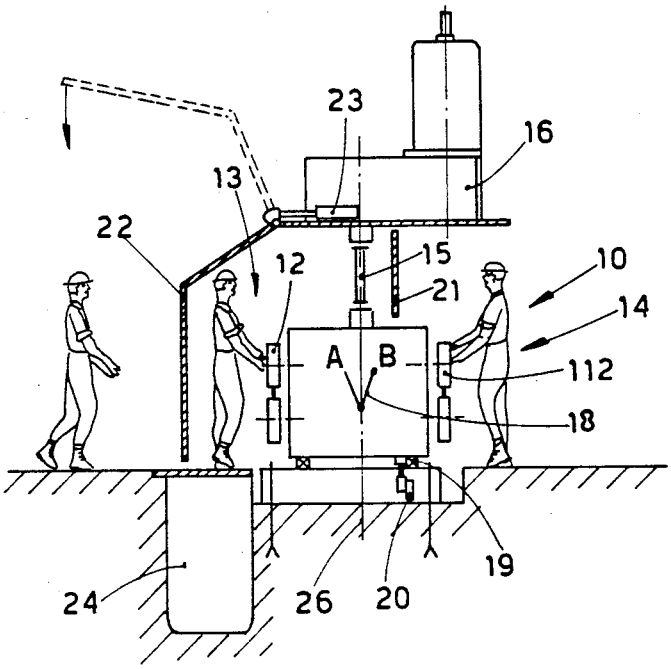
FIG. 1 shows an embodiment according to the invention as applied to a rolling mill having its rolls supported as cantilevers with a horizontal rolling axis.

In the figures the same parts or parts having the same functions bear the same reference numbers.

A rolling stand 10 with rolls 12 supported as cantilevers has a working or rolling axis 11. Such rolling stand 10 comprises rolls 12 supported as cantilevers in a working area 13 and rolls 112 supported as cantilevers in a working area 14.

Each set of rolls 12–112 is driven independently and a selector switch 18 is provided.

The rolling stand 10 gets its motion through a transmission shaft 15, which receives its motion from a motor 16; transmission shafts 17 with bevel gear pairs are possibly included.

Figure 2:
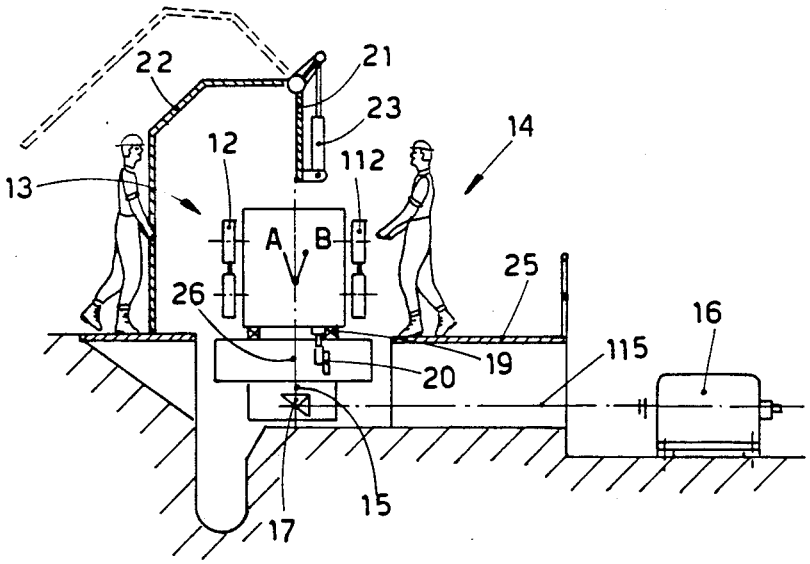
FIG. 2 shows a variant of FIG. 1.
Figure 3:
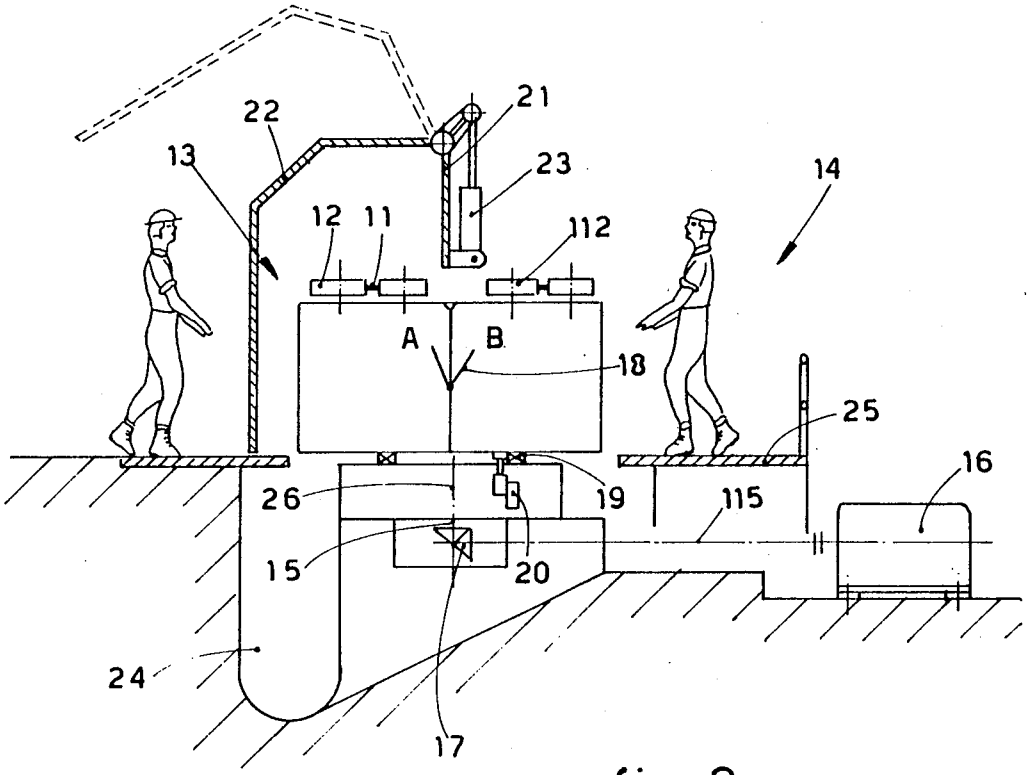
FIG. 3 shows an embodiment according to the invention as applied to a rolling mill having its rolls supported as cantilevers with a vertical/vertical rolling axis.
Figure 4:
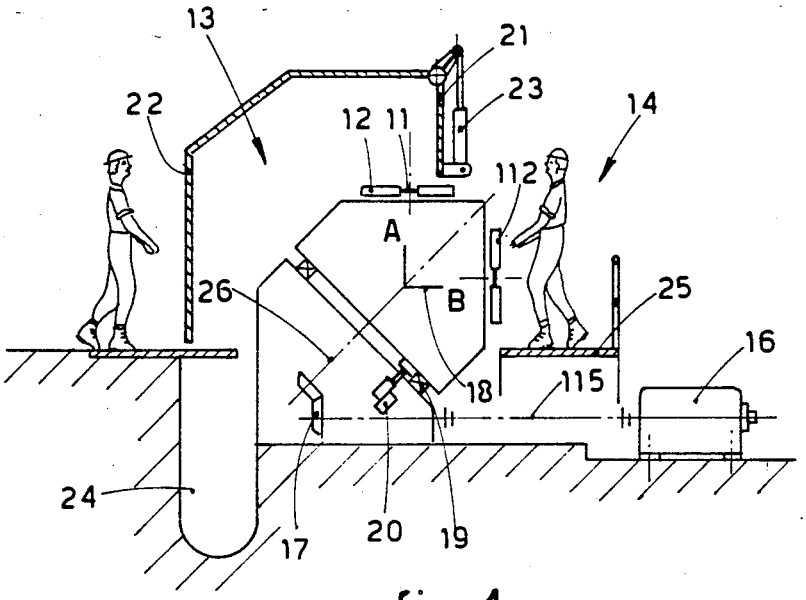
FIGS. 4 and 5 show two solutions in which the rolls supported as cantilevers have a horizontal/vertical rolling axis and viceversa.
Figure 5:
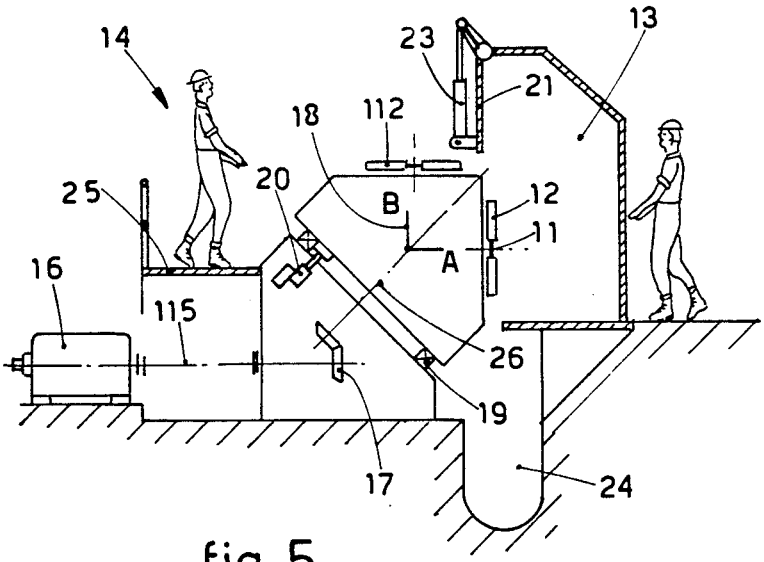

The motor 16 may be located above the stand 10 (as in FIG. 1, for instance), or below or at the side of the stand (as in FIG. 2, for example), or on the same axis as the transmission shaft 15 but below the stand 10. Such combinations may be applied to all the embodiments shown.

The selector actuation switch 18 may be normal and automatic.

Connecting-up may be performed by the machine operator or by the automatic positioning of the rolling stand 10.

In a variant a transient actuation, which is actuated from the area 14, may be provided and serves to control the rotation of the rolls when they have been changed.

A separator screen 21 is positioned between the replacement area 14 and the working area 13.

The working area 13 is provided with a movable shield 22, which can slide or be overturned, for instance by a control jack 23.

The rolling stand 10 cooperates with a drainage channel 24 in the working area 13.

According to the invention a footstep bearing 19 is positioned below the rolling stand 10 and cooperates with a motor 20 that causes rotation.

The axis 26 of the footstep bearing 19 passes through the median of the pair of twin rolls 12–112, which are thus located as counterparts to each other in relation to the axis 26 of the footstep bearing 19 or to the axis of rotation of the rolling unit 10.

The replacement and maintenance area 14 may be brought to a suitable level to enable the personnel employed to have ready access to the rolls 112 along a gangway 25.

While the pair of rolls 12 supported as cantilevers is processing the rolled stock in the working area 13, the machine operator in the replacement area 14 is taking steps to replace the cantilever rolls 112 or possible equipment either manually or by means of robot equipment or is performing control operations or minor maintenance work.

When the lot to be rolled has been completed and production is to be changed, action is taken on the rotation motor 20 so as to move the pair of rolls 112 into the working area 13 and the pair of rolls 12 into the replacement and maintenance area 14. When this has been done, the rolls 112 are ready to roll the successive lot whereas the rolls 12 are replaced with another pair having the required groove.

The presence of the selector switch 18 ensures that the rolls 12 or 112 in the replacement area 14 are not set in motion accidentally.

The rolling stand 10 according to the invention comprises within its interior a twofold set of means so as to provide twin outputs of actuation of the pairs of rolls 12 and 112 respectively.

In a variant the rolling stand 10 could comprise one single output with rolls 12 but would rest on the footstep bearing 19 with longer resetting times. In this case, at the end of one lot, the rolls 12 are rotated into the replacement area 14, are replaced and then taken back to the working area 13.

We claim:

1. A rolling mill having easy access to the rolling units, said mill comprising:

a rotatable rolling stand rotatable about a central axis;

two pairs of cantilevered rolls supported on said stand, each of said pairs located on an opposing side of said central axis, each of said rolls having a rolling axis;

a working area located adjacent to said stand on one side of said central axis for processing rolled stock;

a replacement area located adjacent to said stand on the other side of said central axis for replacing or maintaining parts of said system;

a separator screen dividing said working area and said replacement area; and a protective movable shield surrounding said working area;

said stand being rotatable so as to assume a first or a second position to selectively orient each of said pairs first in said working area and then in said replacement area.

2. A rolling mill as in claim 1, further comprising a footstep bearing for supporting said stand for rotation, said footstep bearing having an axis coinciding with said central axis.

3. A rolling mill as in claim 1 further comprising drive means for driving said rolls and a selector actuation switch means coupled to said drive means for actuating said drive means to selectively operate one of said pairs of rolls.

4. A rolling mill as in claim 3, wherein said selector actuation switch means is manually connectable.

5. A rolling mill as in claim 3, wherein said selector actuation switch means is automatically connectable.

6. A rolling mill as in claim 1, further comprising a motor and a transmission shaft connecting said motor and said stand, said transmission shaft having a longitudinal axis coaxial with said central axis.

7. A rolling mill as claimed in claim 1, wherein said separator screen extends essentially vertically above said rolling stand between the working area and the replacement area.

8. A rolling mill as claimed in claim 7, wherein said movable shield pivots about a point located above said rolling stand, and is movable between a closed position which prevents access to the working area and an open position which allows access to the working area.

9. A rolling mill as claimed in claim 8, further comprising a control jack for moving said movable shield which is mounted to said separator screen.

10. A rolling mill as claimed in claim 7, further comprising a motor for driving the rolls located on a platform above the rolling stand and a transmission shaft connecting said motor and said rolling stand, said transmission shaft being located in the working area.

11. A rolling mill as claimed in claim 10, wherein said movable shield pivots about a point on said platform, and is movable between a closed position which prevents access to the working area and an open position which allows access to the working area.

12. A rolling mill as claimed in claim 11, further comprising a control jack for moving said movable shield located on said platform.

* * * * *